US008054980B2

(12) United States Patent
Wu et al.

(10) Patent No.: US 8,054,980 B2
(45) Date of Patent: Nov. 8, 2011

(54) APPARATUS AND METHOD FOR RENDERING AUDIO INFORMATION TO VIRTUALIZE SPEAKERS IN AN AUDIO SYSTEM

(75) Inventors: Yuan Wu, Singapore (SG); Sapna George, Singapore (SG)

(73) Assignee: STMicroelectronics Asia Pacific PTE, Ltd., Singapore (SG)

( * ) Notice: Subject to any disclaimer, the term of this patent is extended or adjusted under 35 U.S.C. 154(b) by 1480 days.

(21) Appl. No.: 10/656,453

(22) Filed: Sep. 5, 2003

(65) Prior Publication Data

US 2005/0053249 A1 Mar. 10, 2005

(51) Int. Cl.
*H04R 5/00* (2006.01)

(52) U.S. Cl. ..... 381/17; 381/1; 381/18; 381/310

(58) Field of Classification Search ..... 381/309–310, 381/1, 17–18, 306, 303, 61, 86, 74
See application file for complete search history.

(56) References Cited

U.S. PATENT DOCUMENTS

| | | | | |
|---|---|---|---|---|
| 4,388,494 | A * | 6/1983 | Schone et al. | 381/1 |
| 5,742,689 | A * | 4/1998 | Tucker et al. | 381/17 |
| 5,761,315 | A * | 6/1998 | Iida et al. | 381/18 |
| 5,912,976 | A | 6/1999 | Klayman et al. | |
| 6,285,766 | B1 * | 9/2001 | Kumamoto | 381/17 |
| 6,307,941 | B1 * | 10/2001 | Tanner et al. | 381/17 |
| 6,449,368 | B1 * | 9/2002 | Davis et al. | 381/1 |
| 6,668,061 | B1 * | 12/2003 | Abel | 381/1 |
| 6,804,358 | B1 * | 10/2004 | Kawano | 381/17 |
| 7,113,609 | B1 * | 9/2006 | Neidich et al. | 381/305 |
| 7,167,566 | B1 * | 1/2007 | Bauck | 381/17 |
| 7,242,782 | B1 * | 7/2007 | Kasai et al. | 381/97 |
| 7,424,121 | B2 * | 9/2008 | Kubota | 381/310 |
| 2003/0086572 | A1 * | 5/2003 | Sotome et al. | 381/17 |
| 2004/0032955 | A1 * | 2/2004 | Hashimoto et al. | 381/18 |

* cited by examiner

*Primary Examiner* — Devona Faulk
*Assistant Examiner* — Disler Paul
(74) *Attorney, Agent, or Firm* — Lisa A. Jorgenson; William A. Munck

(57) ABSTRACT

An audio processor, apparatus, and method use physical speakers to emulate one or more additional speakers. The physical speakers produce sounds that, from a listener's perspective, appear to come from at least one direction where a physical speaker is not present. Any number of additional speakers can be virtualized, such as three or five speakers that allow two speakers to emulate a 5.1 audio system.

21 Claims, 13 Drawing Sheets

APPARATUS AND METHOD FOR RENDERING AUDIO INFORMATION TO VIRTUALIZE SPEAKERS IN AN AUDIO SYSTEM

TECHNICAL FIELD

This disclosure is generally directed to sound processing systems and more specifically to an apparatus and method for rendering audio information to virtualize speakers in an audio system.

BACKGROUND

Multi-channel sound systems have become increasingly popular in recent years. While older sound systems often included two speakers placed in front of a listener, multi-channel systems typically use more than two speakers. As an example, in a 5.1 audio system, five speakers and a subwoofer are placed around the listener. In this type of audio system, one speaker is typically placed directly in front of the listener, two speakers in front and to the sides of the listener, and two speakers to the sides and possibly behind the listener. These multi-channel systems typically produce more realistic sound effects, such as more realistic surround sound playback during a movie.

Despite the popularity of these multi-channel systems, many people continue to use conventional two-speaker systems. The use of two speakers in an audio system typically limits or prevents the audio system from producing more realistic sounds using the speakers.

SUMMARY

This disclosure provides an apparatus and method for rendering audio information to virtualize speakers in an audio system.

In one aspect, an audio processor includes a virtualizer operable to process audio information to virtualize at least one speaker so that, from a listener's perspective, sounds appear to come from at least one direction where a physical speaker is not present. The audio processor also includes a controller operable to configure the virtualizer. The virtualizer can be configured to virtualize the at least one speaker at any location in a space around the listener.

In another aspect, a method includes generating first output signals for a first physical speaker and generating second output signals for a second physical speaker. The first output signals emulate effects of a virtual speaker on one ear of a listener, and the second output signals emulate effects of the virtual speaker on another ear of the listener. Each of the output signals also at least partially cancels crosstalk caused by the other output signals.

One or more technical features may be present according to various embodiments of this disclosure. Particular embodiments of this disclosure may exhibit none, some, or all of the following features depending on the implementation. In one embodiment, a system for rendering audio information to virtualize speakers is provided. In particular, the system is capable of rendering audio information so that, from the perspective of a listener, sounds appear to come from one or more directions where speakers are not present. For example, the system may be capable of reproducing multi-channel sound in a two-speaker system in a more realistic fashion. In other words, using two speakers, the system makes it appear to a listener that sounds are being produced by additional "virtual" speakers around the listener.

In particular embodiments, the system is capable of rendering audio information for any number of virtual speakers. For example, the system could allow a two-speaker system to emulate a 5.1 audio system more realistically. In this example, the sounds produced by the two speakers may, from the listener's perspective, appear as if they were produced by five speakers around the listener.

This has outlined rather broadly several features of this disclosure so that those skilled in the art may better understand the DETAILED DESCRIPTION that follows. Additional features may be described later in this document. Those skilled in the art should appreciate that they may readily use the concepts and the specific embodiments disclosed as a basis for modifying or designing other structures for carrying out the same purposes of this disclosure. Those skilled in the art should also realize that such equivalent constructions do not depart from the spirit and scope of the invention in its broadest form.

Before undertaking the DETAILED DESCRIPTION below, it may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, or software, or a combination of at least two of the same. It should be noted that the functionality associated with any particular controller may be centralized or distributed, whether locally or remotely. Definitions for certain words and phrases are provided throughout this patent document, and those of ordinary skill in the art should understand that in many, if not most instances, such definitions apply to prior as well as future uses of such defined words and phrases.

BRIEF DESCRIPTION OF THE DRAWINGS

For a more complete understanding of this disclosure and its features, reference is now made to the following description taken in conjunction with the accompanying drawings, in which.

DETAILED DESCRIPTION

Figure 1:
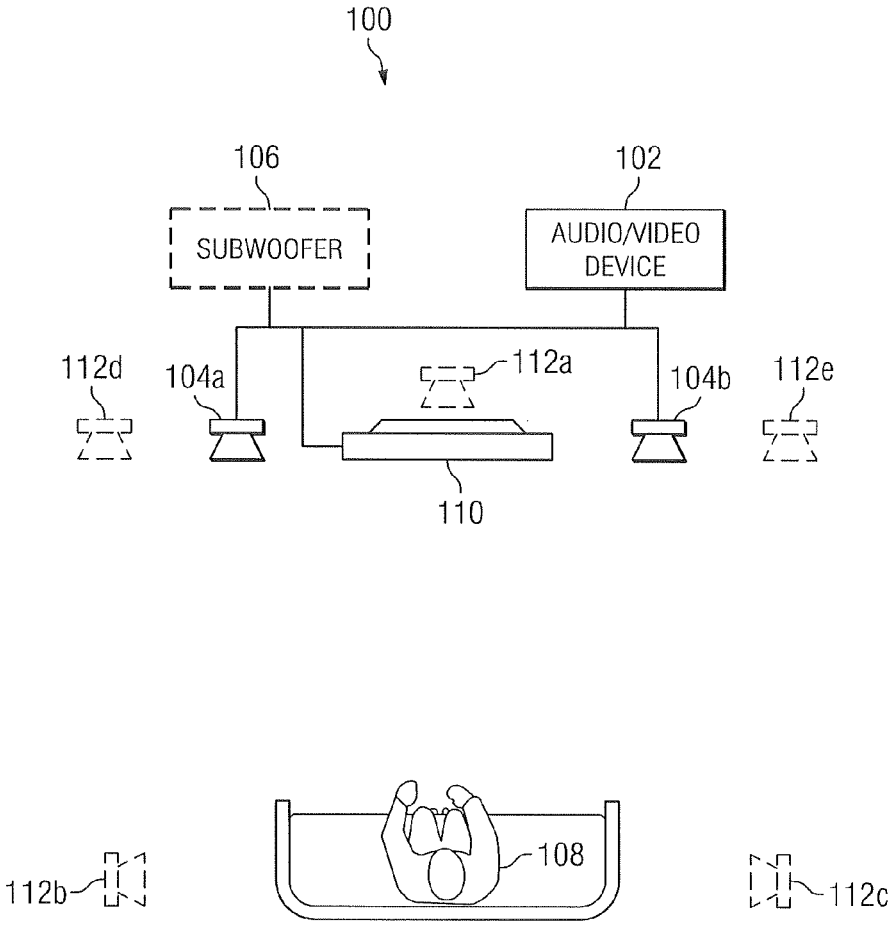
FIG. 1 illustrates an example audio system according to one embodiment of this disclosure.

FIG. 1 illustrates an example audio system 100 according to one embodiment of this disclosure. In the illustrated example, the audio system 100 includes an audio/video device 102 and two speakers 104*a* and 104*b*. Other embodiments of the audio system 100 may be used without departing from the scope of this disclosure.

The audio/video device 102 is coupled to the speakers 104*a* and 104*b*. The audio/video device 102 could also be coupled to a subwoofer 106. In this document, the term "couple" and its derivatives refer to any direct or indirect communication between two or more elements, whether or not those elements are in physical contact with one another. The audio/video device 102 receives or generates audio information, which is sent to the speakers 104 and possibly the subwoofer 106 for presentation to one or more listeners 108. In this document, the phrase "audio information" refers to any signal, pattern, or other information that symbolizes, characterizes, or otherwise represents audio sounds, whether the information is in digital, analog, or other form.

The audio/video device 102 represents any device, system, or part thereof that is capable of providing audio information to one or more speakers 104. The audio/video device 102 could also include functionality for receiving or generating video information for display on a television 110 or other display device. As particular examples, the audio/video device 102 could represent a television tuner or receiver, a compact disk ("CD") player, a digital versatile disk ("DVD") player, an audio tuner or receiver, a desktop, laptop, or server computer, or any other suitable device.

In one aspect of operation, the audio/video device 102 is capable of rendering audio information to create the appearance of one or more "virtual" speakers 112*a*-112*e*. A virtual speaker 112 represents a direction from which the listener 108 believes sounds are originating. In other words, the two actual speakers 104 produce sounds that the listener 108 believes are coming from one or more directions other than from the speakers 104. For example, the audio/video device 102 could make it appear as if sounds are coming from a center speaker 112*a* directly in front of the listener 108. The audio/video device 102 could also make it appear as if sounds are coming from two surround sound speakers 112*b* and 112*c* to the sides of and possibly behind the listener 108. In addition, the audio/video device 102 could make it appear as if sounds are coming from two front speakers 112*d* and 112*e* in front of and to the sides of the listener 108.

Figure 2A:
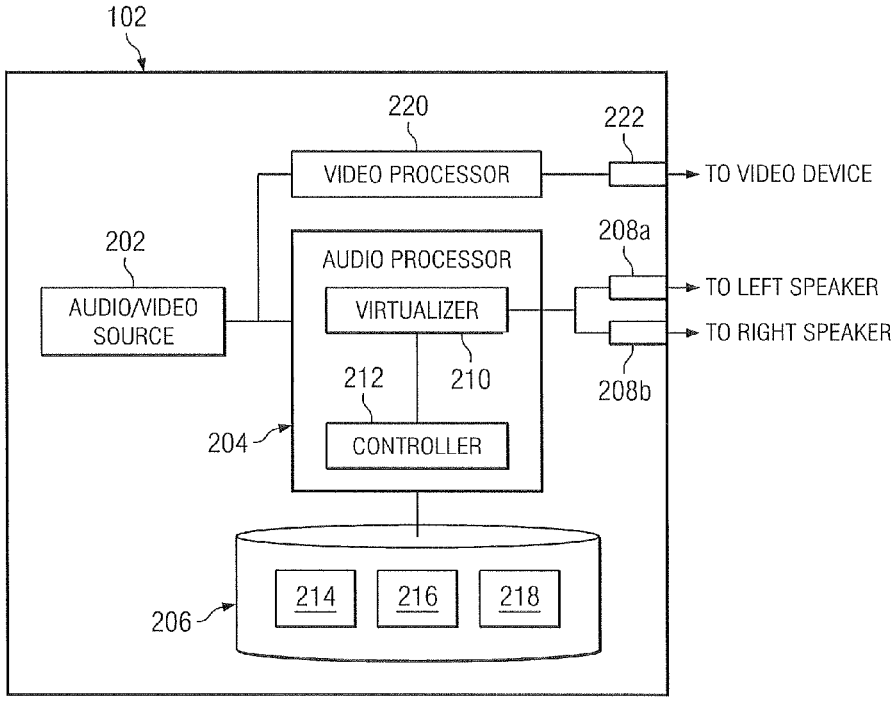
FIGS. 2A and 2B illustrate example audio/video devices according to one embodiment of this disclosure.
Figure 2B:
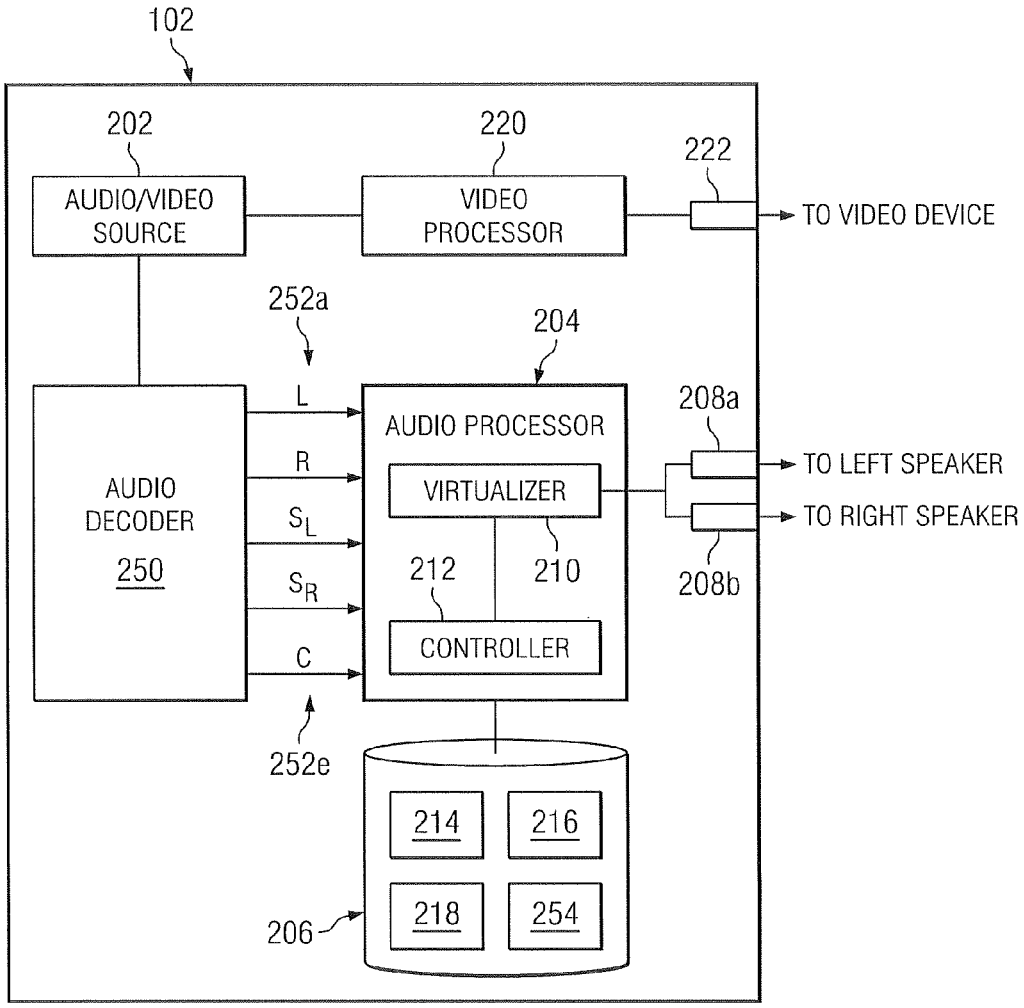

The audio/video device 102 includes any hardware, software, firmware, or combination thereof for virtualizing one or more speakers 112. Example embodiments of the audio/video device 102 are shown in FIGS. 2A and 2B, which are described below. Although FIG. 1 has described the audio system 100 as including an audio/video device 102, a device 102 that omits the video functionality could also be used in the audio system 100.

While FIG. 1 has shown two physical speakers 104 virtualizing one or more virtual speakers 112, the system 100 could include any number of physical speakers 104. Also, any number of physical speakers 104 could be used to virtualize at least one virtual speaker 112. For example, three speakers 104 could be used in the system 100, and two of the three speakers 104 could be used to virtualize two additional virtual speakers 112. As a particular example, a system 100 could include three speakers 104 (two as shown in FIG. 1, one in the position of a virtual speaker 112), and the two speakers 104 in front of the listener 108 could virtualize the remaining four virtual speakers 112 shown in FIG. 1.

Although FIG. 1 illustrates one example of an audio system 100, various changes may be made to FIG. 1. For example, the number and positions of the virtual speakers 112 shown in FIG. 1 are for illustration only. The audio/video device 102 could virtualize any number of speakers 112 at any location or locations without departing from the scope of this disclosure. Also, the audio system 100 could include any number of real speakers 104.

FIGS. 2A and 2B illustrate example audio/video devices 102 according to one embodiment of this disclosure. In these example embodiments, the audio/video device 102 includes an audio/video source 202, an audio processor 204, a memory 206, and two outputs 208. Other embodiments of the audio/video devices 102 could be used without departing from the scope of this disclosure.

In FIG. 2A, the audio/video source 202 is coupled to the audio processor 204. The audio/video source 202 represents any suitable source of audio information. For example, the audio/video source 202 could represent a CD or DVD reader capable of extracting audio information from a CD or DVD. The audio/video source 202 could also represent a radio tuner capable of capturing transmitted radio signals. The audio/video source 202 could further represent a television tuner, such as a high definition television ("HDTV") tuner, capable of capturing transmitted television signals that include audio signals. The audio/video source 202 could represent any other or additional source of audio information.

Audio information from the audio/video source 202 is provided to the audio processor 204. The audio processor 204 processes the audio information for presentation to one or more listeners 108. For example, the audio processor 204 could process the audio information to virtualize one or more virtual speakers 112. The audio processor 204 includes any hardware, software, firmware, or combination thereof for processing audio information. As particular examples, the audio processor 204 could include one or more microprocessors, digital signal processors ("DSPs"), field programmable gate arrays ("FPGAs"), application specific integrated circuits ("ASICs"), or any other suitable processor or processors.

In the illustrated example, the audio processor 204 includes a virtualizer 210 and a controller 212. The virtualizer 210 and controller 212 could, for example, represent different hardware components or different software programs executed by the audio processor 204.

The virtualizer 210 receives the audio information from the audio/video source 202 and processes the audio information to virtualize one or more speakers 112. For example, the virtualizer 210 could process the audio information to virtualize a speaker 112*a* directly in front of the listener 108. The virtualizer 210 could also process the audio information to virtualize two surround sound speakers 112*b* and 112*c* to the sides of the listener 108.

The virtualizer 210 virtualizes one or more speakers 112 based on the psycho-acoustical properties of the human auditory system. When sound waves reach a person, the person's eardrums respond to the sound waves, and the brain analyzes the responses of both eardrums. Based on this analysis, the brain makes a judgment about the location where the sound waves originated.

In some embodiments, the response of an eardrum to sound sources at certain locations in space can be described using the concepts of Head-Related Impulse Responses ("HRIP") and Head-Related Transfer Functions ("HRTF"). A Head-Related Impulse Response is defined as the response of an eardrum excited by an impulse signal from a certain point in space. The HRIP is typically a function of azimuth, elevation, and range in relation to the source of an impulse signal. In particular embodiments, for "far field" situations where the range exceeds a threshold (such as one meter), the HRIP may be considered invariable to range.

The Head-Related Transfer Function is defined as the frequency response of the eardrum towards a certain point in space. The HRTP represents the Fourier transform of the HRIP. For far field situations, at an elevation of zero degree, the HRTF is a function of azimuth θ and can be denoted as H(θ). Measured HRTFs with different experimental conditions are available, such as in the CIPIC Interface Laboratory's CIPIC HRTF database and MIT Media lab's HRTF Measurements of a KEMAR Dummy-Head Microphone.

If a speaker was physically present at the location of a virtual speaker 112, impulse responses would be received at the ears of the listener 108. To create a virtual speaker 112, the ears of the listener 108 should receive the same or similar impulse responses from the actual speakers 104 that would be received if a real speaker was present at the location of the virtual speaker 112. In some embodiments, the virtualizer 210 makes use of the characteristics of HRTFs during the virtualization process. The virtualizer 210 includes any hardware, software, firmware, or combination thereof for virtualizing one or more speakers 112. Example virtualizers 210 are shown in FIGS. 4-6, 7A, and 8A, and the operation of these virtualizers 210 are described below.

The controller 212 controls the operation of the virtualizer 210. For example, in some embodiments, the virtualization of the speakers 112 can be customized based on parameters 214-218 stored in the memory 206. The controller 212 represents any hardware, software, firmware, or combination thereof for configuring or otherwise controlling the operation of the virtualizer 210.

The memory 206 is coupled to the audio processor 204. The memory 206 stores and facilitates retrieval of information used by the audio processor 204 to process audio information. For example, the memory 206 may store the parameters 214-218 used by the controller 212 to configure the virtualizer 210. The memory 206 includes any hardware, software, firmware, or combination thereof for storing and facilitating retrieval of information, such as a volatile or non-volatile device or devices.

The memory 206 stores and the controller 212 uses any suitable parameters to configure the virtualizer 210. For example, as described above, the virtualizer 210 may use HRTFs to virtualize one or more speakers 112. HRTFs typically vary based on individual listeners 108 and on the position of the actual speakers 104. Also, different listeners 108 often have different preferences about the locations of the virtual speakers 112. In this example, the virtualization of the speakers 112 can be based on parameters such as the position 214 of the actual speakers 104, the number or location 216 of the virtual speaker or speakers 112, and information about the HRTFs 218 of a listener 108. Other or additional parameters could also be used by the controller 212. The controller 212 collects these parameters and configures the virtualizer 210 to give the desired audio effect.

The audio information processed by the audio processor 204 is provided to the two speakers 104 through outputs 208*a* and 208*b*. The outputs 208 represent any suitable structure or device capable of providing audio information to the speakers 104. For example, the outputs 208 could represent connectors capable of accepting RCA-type cables or two-wire speaker cables.

Although FIG. 2A illustrates an audio/video source 202 in an audio/video device 102, the device 102 could represent an audio-only device. In these embodiments, the audio device 102 could use an audio source 202 that does not provide any video information. When video information is provided by the audio/video source 202, the video information is sent to a video processor 220. The video processor 220 processes the video information for display on a television 110 or other display device. For example, the video processor 220 may process the video information so that it can be displayed on a Red/Green/Blue ("RGB") device, a Video Graphics Array ("VGA") device, an HDTV device, or a plasma display. The processed video information may be provided to the display device through one or more outputs 222, such as a digital coaxial output or component video outputs.

FIG. 2B illustrates another example embodiment of an audio/video device 102. In this example, the audio/video device 102 is similar to the device 102 shown in FIG. 2A. In addition to the components described above with respect to FIG. 2A, the audio/video device 102 in FIG. 2B includes an audio decoder 250. In this example embodiment, the audio/video source 202 provides audio information that has been encoded, such as audio information that has been encoded using the 5.1 or other multi-channel standard. The audio decoder 250 receives and decodes the encoded audio information. In decoding the audio information, the audio decoder 250 may separate the audio information into the various channels 252*a*-252*e*. As a particular example, the audio decoder 250 may separate the audio information into left and right front channels 252*a* and 252*b*, left and right surround sound channels 252*c* and 252*d*, and a center channel 252*e*. Other decoding schemes associated with any number of channels may be used by the audio decoder 250. The audio decoder 250 includes any hardware, software, firmware, or combination thereof for decoding audio information.

In this example embodiment, the controller 212 in the audio processor 204 also uses a listening mode parameter 254 to configure the virtualizer 210. In some embodiments, the audio processor 204 can virtualize the location of the speakers 112 differently to alter the perceived position of one or more of the virtual speakers 112. The different perceived positions of the virtual speakers 112 may correspond to different listening modes that can be selected by a listener 108. As a particular example, the virtual surround sound speakers 112*b* and 112*c* could be located either directly to the sides of the listener 108 or to the sides and behind the listener 108, depending on the listening mode parameter 254 selected. As another example, the virtual front speakers 112*d* and 112*e* may or may not be virtualized, depending on the listening mode parameter 254 selected. Based on the listening mode parameter 254, the controller 212 decides which channels should be virtualized, and the virtualizer 210 processes the audio signals according to the decisions made by the controller 212.

Although FIGS. 2A and 2B illustrate example embodiments of an audio/video device 102, various changes may be made to FIGS. 2A and 2B. For example, the video processor 220 need not be provided in the devices 102. Also, FIGS. 2A and 2B have been simplified for ease of illustration and explanation. Other embodiments of the devices 102 including other or additional components could also be used. In addition, the functional divisions shown in FIGS. 2A and 2B are for illustration only. Various components could be combined or omitted and additional components could be added according to particular needs.

Figure 3:
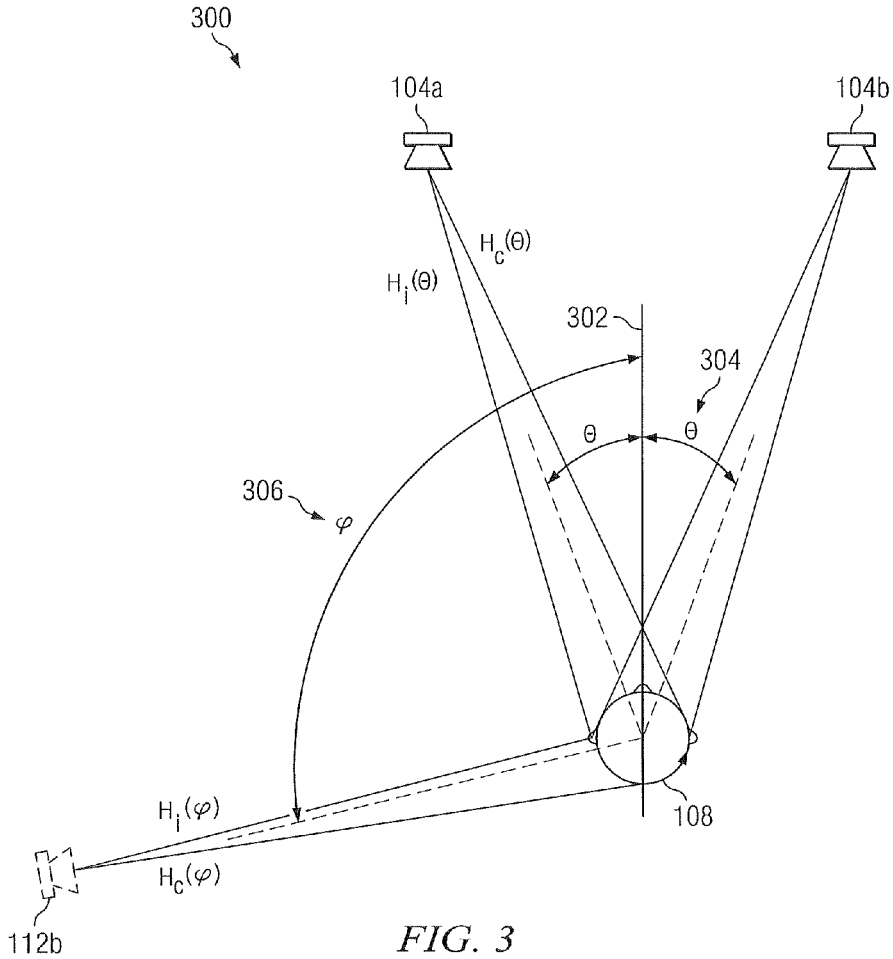
FIG. 3 illustrates an example virtualization of a speaker according to one embodiment of this disclosure.

FIG. 3 illustrates an example virtualization 300 of a virtual speaker 112 according to one embodiment of this disclosure. In particular, FIG. 3 illustrates the virtualization of a virtual surround sound speaker 112*b* that is positioned to the left and behind a listener 108. Although FIG. 3 describes the virtualization of this particular virtual speaker 112*b* in a particular location, the principles shown and described below can be used to virtualize one or multiple speakers 112 at any suitable location or locations.

As described above, in some embodiments, the virtualizer 210 uses HRTFs to virtualize one or more virtual speakers 112. The example shown in FIG. 3 illustrates the creation of a virtual speaker 112*b* that is closer to the left ear of the listener 108. In this example, for ease of illustration and explanation, the space around the listener 108 is divided into two halves by a centerline 302. Also shown in FIG. 3 is the angle (θ) 304 between the centerline 302 and each physical speaker 104 and the angle (ϕ) 306 between the centerline 302 and the virtual speaker 112*b*.

If a speaker was physically present at the illustrated location of the virtual speaker 112, the left ear of the listener 108 would first receive sound waves from the speaker 112*b*. After some amount of time, the right ear of the listener 108 would receive sound waves from the speaker 112*b*. The transfer function from the virtual speaker 112*b* to the listener's left ear is represented as $H_i(\phi)$. The transfer function from the virtual speaker 112*b* to the listener's right ear is represented as $H_c(\phi)$. The time difference, $t(\phi)$, between the sound waves from the speaker 112*b* arriving at the listener's ears is defined as the inter-time difference (ITD). Similarly, the transfer function from the left speaker 104*a* to the listener's left ear is represented as $H_i(\theta)$, and the transfer function from the left speaker 104*a* to the listener's right ear is represented as $H_c(\theta)$. The inter-time difference between the sound waves from the speaker 104*a* arriving at the listener's ears is represented as $t(\theta)$.

To create the appearance of a virtual speaker 112*b*, the left speaker 104*a* emulates the impact of the virtual speaker's sound waves on the listener's left ear. The right speaker 104*b* emulates the impact of the virtual speaker's sound waves on the listener's right ear. To emulate the impact to the listener's left ear, the sounds S to be produced by the left speaker 104*a* are transformed by $$\frac{H_i(\phi)}{H_i(\theta)}.$$

Similarly, to emulate the impact to the listener's right ear, the sounds produced by the right speaker 104*b* are transformed by $$\frac{H_c(\phi)}{H_i(\theta)},$$

which is also equal to $$S \times \frac{H_i(\phi)}{H_i(\theta)} \times \frac{H_c(\phi)}{H_i(\phi)} = S_i \times \frac{H_c(\phi)}{H_i(\phi)},$$

where $S_i$ represents the original audio signal S after being filtered by $$\frac{H_i(\phi)}{H_i(\theta)}.$$

Ideally, based on these properties, the virtualizer 210 could produce $S_i$ by filtering the original signal S with a filter having a response of $$\frac{H_i(\phi)}{H_i(\theta)}$$

and sending the resulting signal to the left speaker 104*a*. The virtualizer 210 could also filter $S_i$ using a filter with a response of $$\frac{H_c(\phi)}{H_i(\phi)}$$

and send the resulting signal to the right speaker 104*b*. These signals would ideally emulate the virtual speaker 112*b*.

As shown in FIG. 3, however, the left speaker 104*a* has an impact on the right ear of the listener 108, and the right speaker 104*b* has an impact on the left ear of the listener 108. The effect that a speaker 104 has on the opposite ear of the listener 108 is referred to as "crosstalk." Crosstalk interferes with the ideal operation of the speakers 104, meaning that it can interfere with or destroy the effect of the virtualization. As described below, to reduce or eliminate crosstalk, the output of each speaker 104 is used to generate an out-of-phase signal for the other speaker 104. The out-of-phase signals help to reduce or cancel the crosstalk produced by the speakers 104, which helps to more effectively virtualize the speaker 112*b*.

Although FIG. 3 illustrates one example of the virtualization 300 of a virtual speaker 112*b*, various changes may be made to FIG. 3. For example, any other or additional virtual speakers 112 could be emulated by the speakers 104. Also, the speakers 104 could have any position with respect to the listener 108. As an example, while FIG. 3 illustrates that each speaker 104 is positioned at the same angle 304 from the centerline 302, each speaker 104 could be placed at different angles 304 from the centerline 302.

Figure 4:
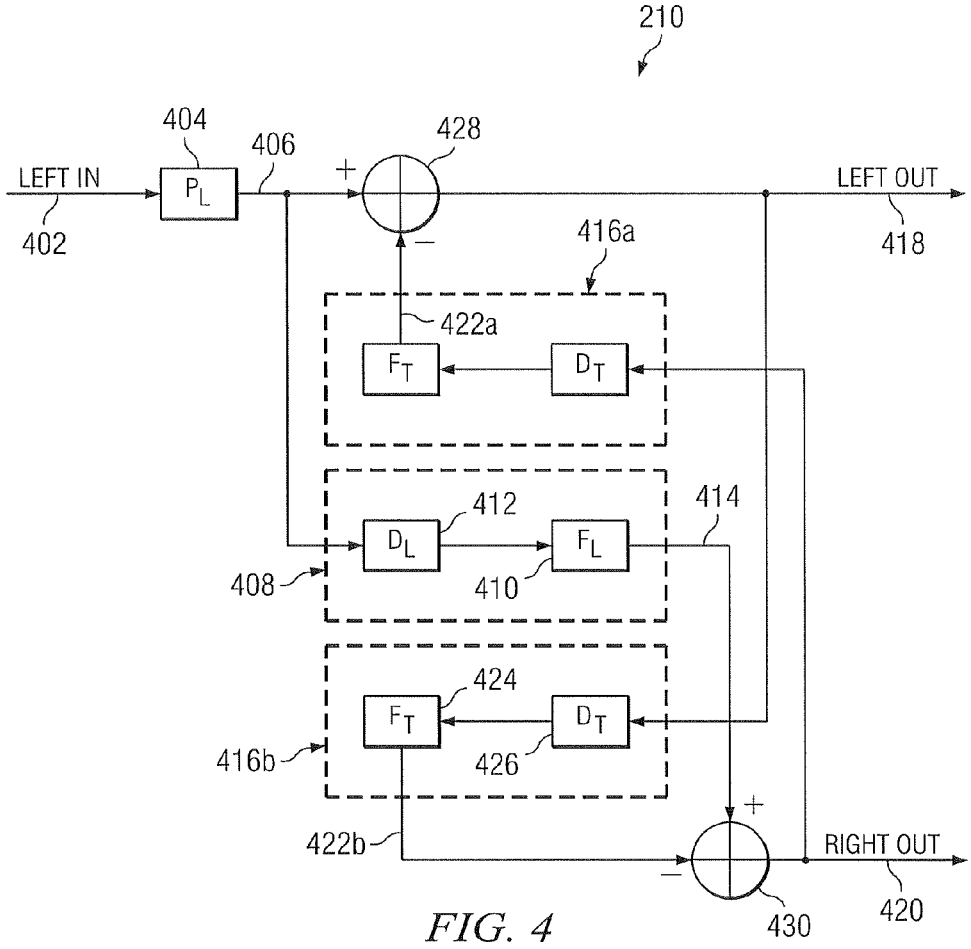
FIG. 4 illustrates an example audio virtualizer for virtualizing one speaker according to one embodiment of this disclosure.

FIG. 4 illustrates an example audio virtualizer 210 for virtualizing one speaker 112 according to one embodiment of this disclosure. In the illustrated example, the speaker 112 being virtualized is closer to the left ear of the listener 108. The same or similar structure could be used to virtualize a speaker 112 closer to the right ear of the listener 108.

As described above, the sounds produced by a real speaker at the location of a virtual speaker 112*b* would have a transfer function of $H_i(\phi)$ for the listener's left ear, a transfer function of $H_c(\phi)$ for the listener's right ear, and an inter-time difference $t(\phi)$. Based on this, the virtualizer 210 in FIG. 4 receives an input signal 402 and processes the input signal 402 so that the speakers 104 produce sounds with the proper transfer functions and inter-time difference.

In this example, the input signal 402 for the left speaker 104*a* is provided to a filter 404. The response of the filter 404, $P_L$, may be determined using the formula:

$$|P_L| = \left|\frac{H_i(\phi)}{H_i(\theta)}\right|.$$

This transform alters the input signal 402 to produce a filtered input signal 406. In the absence of crosstalk, the filtered signal 406 would be provided to the left speaker 104*a*, and it would allow the left speaker 104*a* to emulate the effects of the virtual speaker 112 on the listener's left ear.

The filtered signal 406 is also provided to a forward crossover path 408. The forward crossover path 408 processes the filtered signal 406 before providing it to the right speaker 104*b*. In this example, the forward crossover path 408 includes a filter 410 and a delay line 412.

Ideally, HRTFs contain the proper inter-time difference, and the virtualizer 210 need not alter or provide an extra delay to the signals to emulate the inter-time difference. However, this may require unstable filters having high orders, which are inefficient. Simpler filters and delay lines can be used to approximate the needed filter response.

The filter 410 receives the signal 406 produced by the filter 404 and further filters the signal 406 to produce a signal 414. The response of the filter 410, $F_L$, may be determined using the formula:

$$|F_L| = \left|\frac{H_c(\phi)}{H_i(\phi)}\right|.$$

In the absence of crosstalk, the signal 414 would be provided to the right speaker 104*b*, and it would allow the right speaker 104*b* to emulate the effects of the virtual speaker 112 on the listener's right ear.

Because the filter 410 approximates the filter needed to emulate the virtual speaker 112, the filter 410 may not have the correct delay. As a result, the speakers 104 may produce sounds having an improper inter-time difference. The delay line 412 delays the signal 406 provided to the filter 410 to compensate for the inexact delay of the filter 410. The delay $D_L$ introduced by the delay line 412 may be determined using the formula:

$$D_L = t(\phi) - t(F_L)$$

where $t(\phi)$ represents the desired inter-time difference for the virtual speaker 112, and $t(F_L)$ represents the delay introduced by the filter 410. The inter-time difference $t(\phi)$ could have any value. As an example, when the angle 306 from the centerline 302 to the virtual speaker 112 equals 90°, the inter-time difference could range from 0.65 to 0.70 ms depending on the head shape of the listener 108.

As described above, in the absence of crosstalk, the signals 406 and 414 could be used to emulate the virtual speaker 112. However, the presence of crosstalk can interfere with and possibly destroy the effective emulation of a virtual speaker 112. To compensate for crosstalk, the virtualizer 210 includes two feedback crossover paths 416*a* and 416*b*. The feedback crossover paths 416 process output signals 418, 420 provided to the two speakers 104. Each feedback crossover path 416 takes the output to one speaker 104 and generates an out-of-phase signal 422 for the other speaker 104. The out-of-phase signal 422 allows one speaker 104 to cancel the crosstalk produced by the other speaker 104.

In the illustrated example, each feedback crossover path 416 includes a filter 424 and a delay line 426. The filter 424 receives one of the output signals 418, 420 and filters the output signal to produce the out-of-phase signal 422. The response of the filter 424, $F_T$, may be determined using the formula:

$$|F_T| = \left|\frac{H_c(\theta)}{H_i(\theta)}\right|.$$

Because the filter 424 may approximate the needed filter response, the filter 424 may have an incorrect delay. The delay line 426 delays the output signal 418, 420 provided to the filter 424 to compensate for the inexact delay of the filter 424. The delay $D_T$ introduced by the delay line 426 may be determined using the formula:

$$D_T = t(\theta) - t(F_T)$$

where $t(\theta)$ represents the inter-time difference for left speaker 104, and $t(F_T)$ represents the delay introduced by the filter 424.

The output signals 418, 420 provided to the speakers 104 represent combinations of the various signals produced by the filter 404, the forward crossover path 408, and the feedback crossover paths 416. For example, a combiner 428 produces the output signal 418 for the left speaker 104*a* by combining the signal 406 produced by the filter 404 and the out-of-phase signal 422*a* produced by the feedback crossover path 416*a*. In this way, the left speaker 104*a* uses the output signal 418 to emulate the effects of the virtual speaker 112 on the left ear of the listener 108 while canceling crosstalk from the right speaker 104*b*. A combiner 430 produces the output signal 420 for the right speaker 104*b* by combining the signal 414 produced by the forward crossover path 408 and the out-of-phase signal 422*b* produced by the feedback crossover path 416*b*. In this way, the right speaker 104*b* uses the output signal 420 to emulate the effects of the virtual speaker 112 on the right ear of the listener 108 while canceling crosstalk from the left speaker 104*a*.

The HRTFs and inter-time difference used by the virtualizer 210 can vary from listener 108 to listener 108. For example, they may vary based on the positions of the speakers 104 and the body shape and dimensions of the listener 108. The placement of speakers 104 (defined by the angle 304) affects $H_i(\theta)$, $H_c(\theta)$, and $t(\theta)$. The location of the virtual speaker 112 (defined by angle 306) affects $H_i(\phi)$, $H_c(\phi)$, and $t(\phi)$. The virtualizer 210 can be configured by the controller 212 to take the various parameters into account when virtualizing a speaker 112. In particular, the virtualizer 210 can be configured by altering the responses of the filters 404, 410, 424 and the delay lines 412, 426 accordingly. The virtualizer 210 could also be configured in a non-individualized manner, such as by assuming default values for the angles 304 and 306.

Each of the filters 404, 410, 424 in FIG. 4 could represent any hardware, software, firmware, or combination thereof for filtering signals. As particular examples, the filters 404, 410, 424 could represent Finite Impulse Response ("FIR") or Infinite Impulse Response ("IIR") filters. Each of the delay lines 412, 426 could represent any hardware, software, firmware, or combination thereof for delaying a signal. As a particular example, the delay lines 412, 426 may be implemented as circular buffers. In addition, as shown in FIG. 4, the out-of-phase signal 422 produced by each feedback crossover path 416 is inverted (subtracted). In some embodiments, the inversion of the out-of-phase signals 422 can be integrated into and performed by the filters 424. This may be done, for example, when the virtualizer 210 is implemented using one or more DSPs.

In particular embodiments, the amplitude of the frequency response $P_L$ for filter 404 equals the amplitude of $$\frac{H_i(\phi)}{H_i(\theta)},$$

and the filter 404 has a linear phase ideally. The amplitude of the frequency response $F_L$ for filter 410 equals the amplitude of $$\frac{H_c(\phi)}{H_i(\phi)},$$

and the amplitude of the frequency response $F_T$ for filter 424 equals the amplitude of $$\frac{H_c(\theta)}{H_i(\theta)}.$$

The filters 410, 424 may show low-pass characteristics and, for non-individualized design, can be implemented by low-pass filters with small (first or second) orders. In addition, the filter response $F_L$ may depend on the azimuth associated with the virtual speaker 112, and the filter response $F_T$ may depend on the azimuth of the speakers 104.

Figure 5:
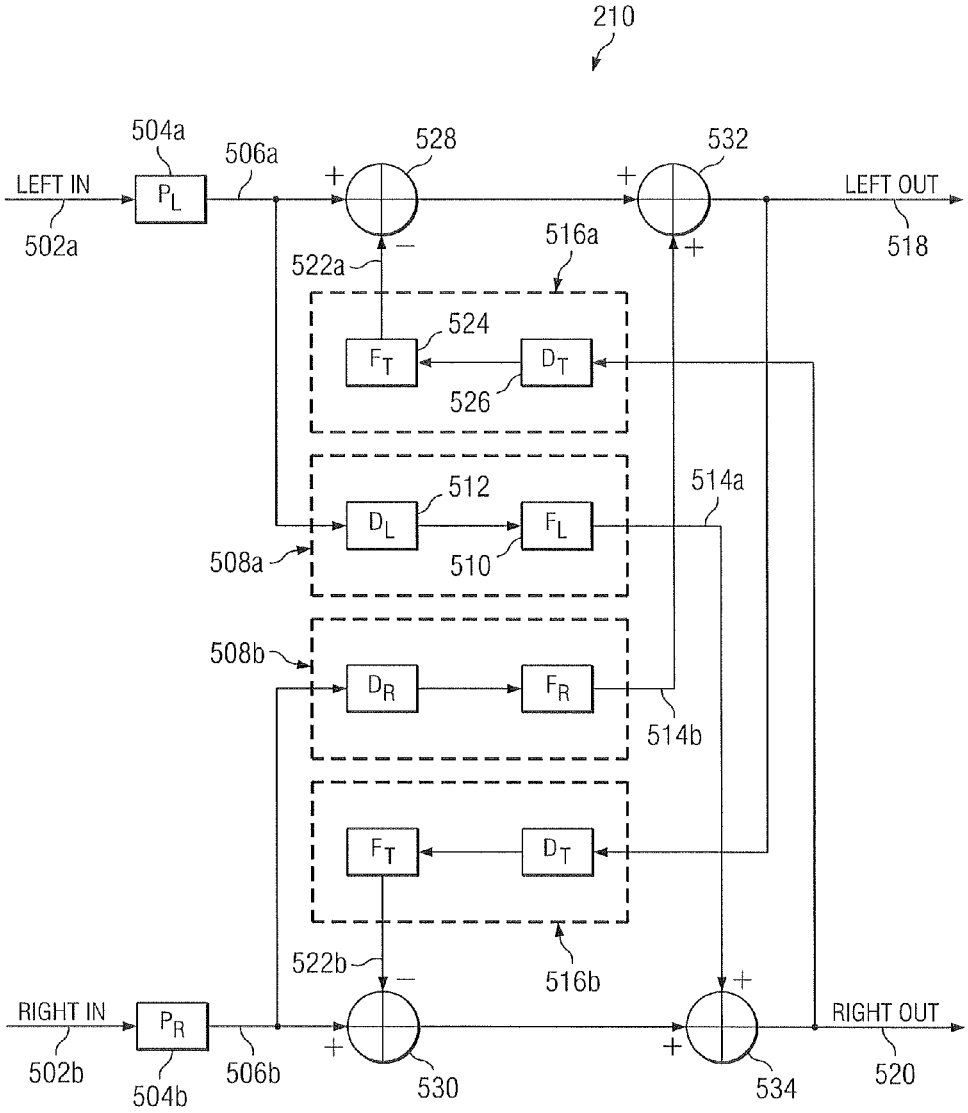
FIG. 5 illustrates an example audio virtualizer for virtualizing two speakers according to one embodiment of this disclosure.

FIG. 5 illustrates an example audio virtualizer 210 for virtualizing two speakers according to one embodiment of this disclosure. The audio virtualizer 210 shown in FIG. 5 virtualizes two virtual speakers 112, one closer to the listener's left ear and one closer to the listener's right ear.

The virtualizer 210 in FIG. 5 operates in a similar manner as the virtualizer 210 shown in FIG. 4. The virtualizer 210 in FIG. 5 receives two input signals 502*a* and 502*b*. The input signals 502*a* and 502*b* are provided to two filters 504*a* and 504*b*, which produce two filtered signals 506*a* and 506*b*. The filtered signals 506*a* and 506*b* are provided to two forward crossover paths 508*a* and 508*b*, which process the filtered signals 506*a* and 506*b* to produce signals 514*a* and 514*b*. Each of the forward crossover paths 508*a* and 508*b* includes a filter 510 and a delay line 512.

The virtualizer 210 in FIG. 5 also includes two feedback crossover paths 516*a* and 516*b*. The feedback crossover paths 516 process output signals 518 and 520 that are provided to the speakers 104 and generate out-of-phase signals 522 used to cancel crosstalk. Each feedback crossover path 516 includes a filter 524 and a delay line 526.

The output signals 518, 520 provided to the speakers 104 represent combinations of the various signals produced by the filters 504, the forward crossover paths 508, and the feedback crossover paths 516. For example, a combiner 528 combines the filtered signal 506*a* produced by the filter 504*a* and the out-of-phase signal 522*a* produced by the feedback crossover path 516*a*. Another combiner 532 combines the output of the combiner 528 and the signal 514*b* produced by the forward crossover path 508*b*. The output of the combiner 532 represents the output signal 518. Similarly, a combiner 530 combines the filtered signal 506*b* produced by the filter 504*b* and the out-of-phase signal 522*b* produced by the feedback crossover path 516*b*. Another combiner 534 combines the output of the combiner 530 and the signal 514*a* produced by the forward crossover path 508*a*. The output of the combiner 534 represents the output signal 520.

The various frequency responses of the filters 504, 510, 524 and the delays introduced by the delay lines 510, 526 may be determined using the formulas provided above in FIG. 4. The audio processor 204 simply needs to identify the various angles 304, 306 associated with the speakers 104, 112 to properly configure the filters and delay lines. Moreover, if the virtual speakers 112 are symmetrical with respect to the centerline 302, the properties of the filters and delay lines may be symmetrical.

Figure 6:
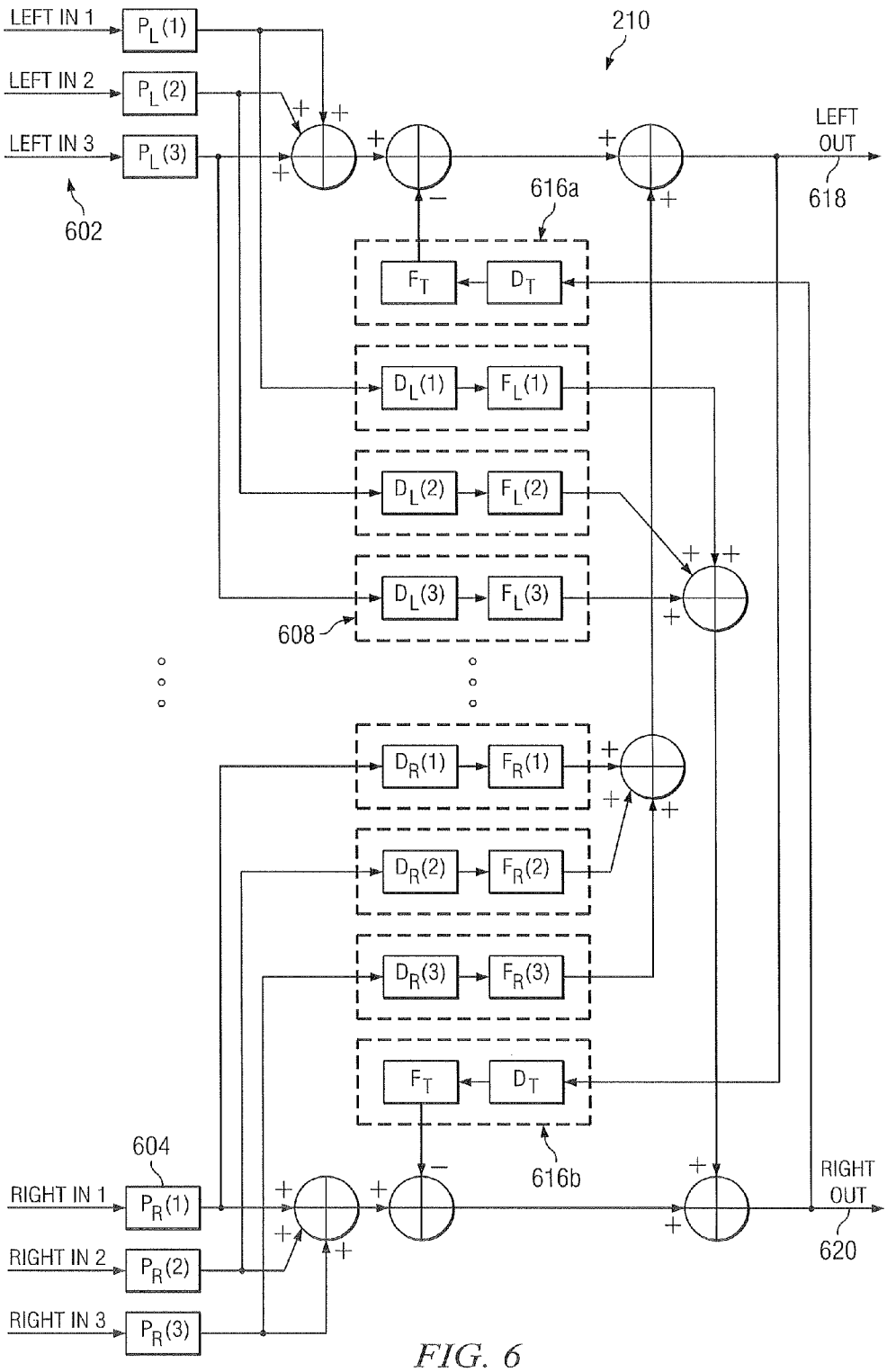
FIG. 6 illustrates an example audio virtualizer for virtualizing n speakers according to one embodiment of this disclosure.

FIG. 6 illustrates an example audio virtualizer 210 for virtualizing n speakers 112 according to one embodiment of this disclosure. In this example, the n virtual speakers 112 are illustrated such that at least three are to the left of the centerline 302 and at least three are to the right of the centerline 302. Other positions of the virtual speakers 112 could be used.

The virtualizer 210 shown in FIG. 6 operates in a similar manner as the virtualizers 210 shown in FIGS. 4 and 5. Each of n input signals 602 is provided to and filtered by one of n filters 604. Each of the filtered signals is then provided to one of n forward crossover paths 608. The virtualizer 210 also includes two feedback crossover paths 616*a* and 616*b*, each of which produces signals used to reduce or cancel crosstalk. The output signals 618 and 620 for the speakers 104 are produced by combining various ones of the filtered signals, the signals produced by the forward crossover paths 608, and the signals produced by the feedback crossover paths 616.

The various frequency responses of the filters and the delays introduced by the delay lines may be determined using the formulas provided above in FIG. 4. The audio processor 204 simply needs to identify the various angles 304, 306 associated with the speakers 104, 112 to properly configure the filters and delay lines. While FIG. 6 shows at least six speakers 112 being virtualized by the audio processor 204, any number of speakers 112 could be virtualized in the same or similar manner.

Figure 7A:
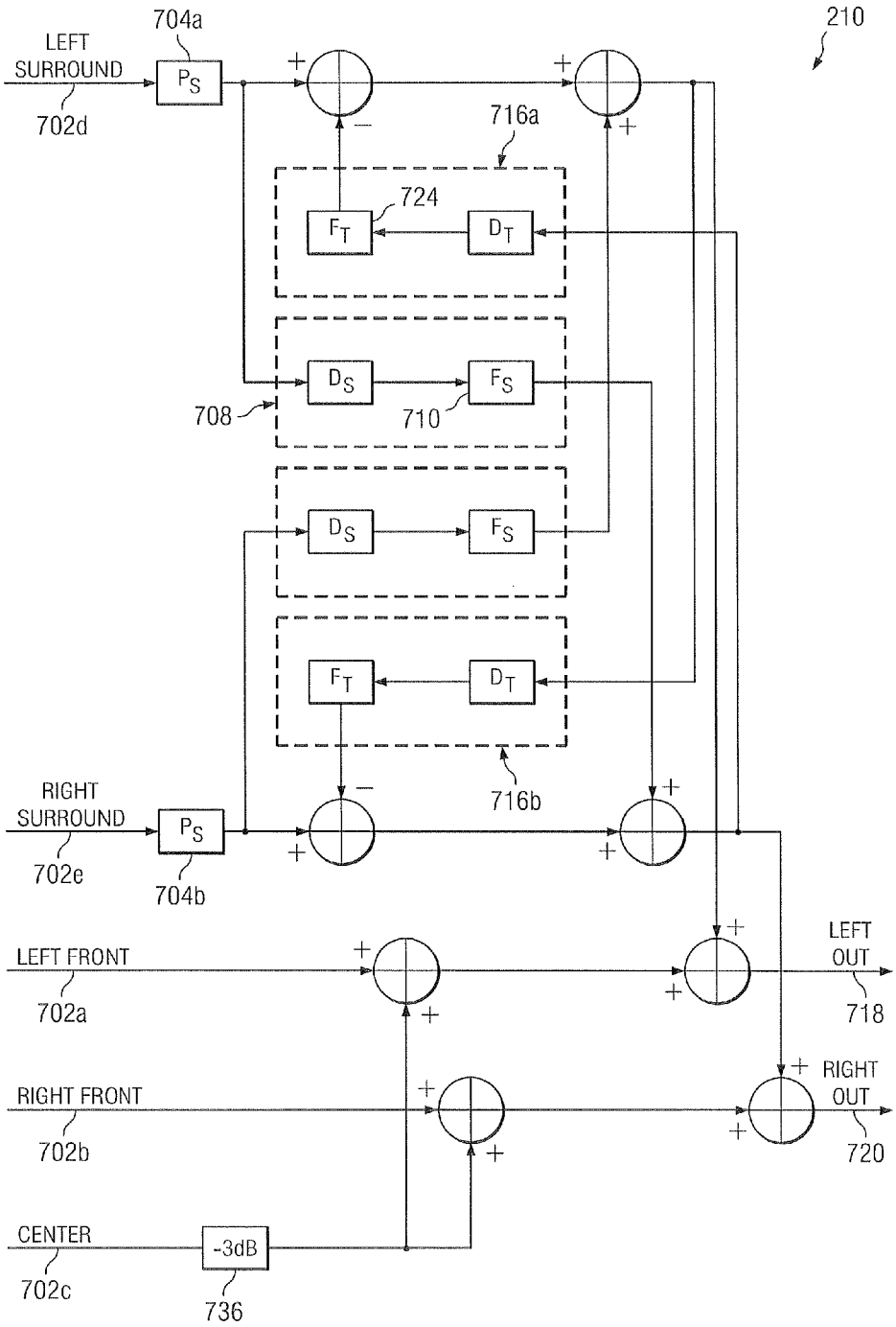
FIGS. 7A and 7B illustrate an example audio virtualizer for emulating a 5.1 audio system according to one embodiment of this disclosure.
Figure 7B:
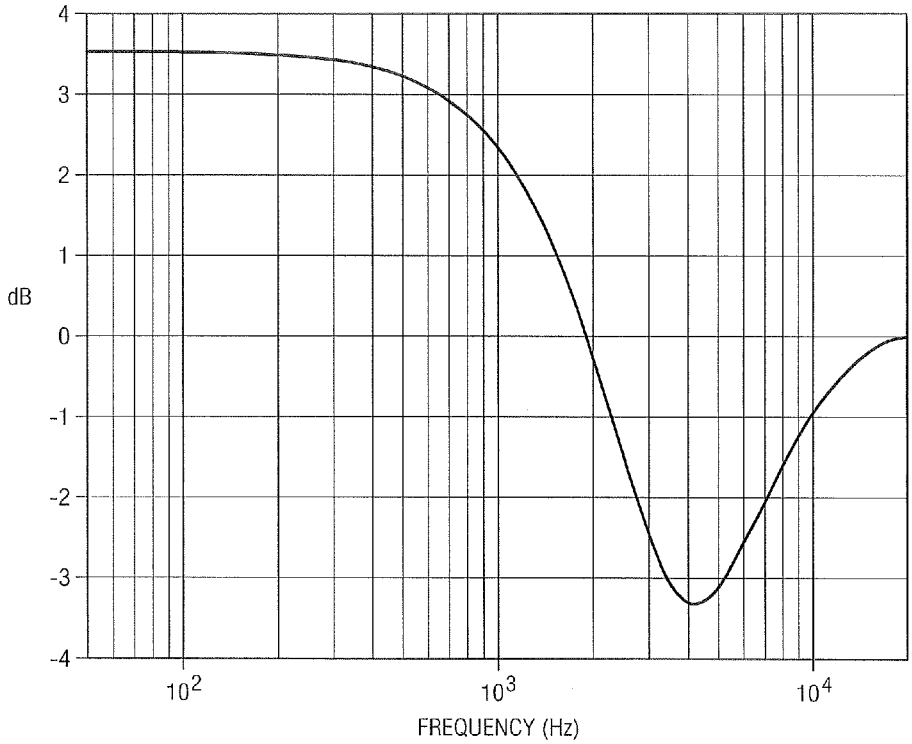

FIGS. 7A and 7B illustrate an example audio virtualizer 210 for emulating a 5.1 audio system according to one embodiment of this disclosure. FIGS. 7A and 7B illustrate one example of a virtualizer 210 for emulating a 5.1 audio system. Other virtualizers 210 could also be used to emulate a 5.1 audio system.

The virtualizer 210 shown in FIG. 7A emulates a 5.1 audio system. The 5.1 standard represents one of the dominant multi-channel audio standards currently used. In this type of audio system, one speaker 112*a* is typically placed directly in front of the listener 108, two speakers 112*b* and 112*c* to the sides and possibly behind the listener 108, and two speakers 112*d* and 112*e* in front and to the sides of the listener 108. While the virtualizers 210 shown in FIGS. 4-6 have generally been described as virtualizing speakers 112 in various locations around the listener 108, the virtualizer 210 shown in FIG. 7A virtualizes speakers 112 to emulate a specific audio standard. In particular, the front two speakers 112*d* and 112*e* in the 5.1 audio system are assumed to be located in the same positions as the actual speakers 104. The virtualizer 210 then virtualizes a center speaker 112*a* and two surround sound speakers 112*b* and 112*c*.

In this example, the input signals 702*a* and 702*b* for the front two speakers 112*d* and 112*e* are simply combined with other signals and output to the speakers 104. Because the front two speakers 112*d* and 112*e* are located at the same locations as the actual speakers 104, these inputs need not be further processed.

To virtualize the center speaker 112*a*, an attenuator 736 receives an input signal 702*c* for the center speaker 112*a* and attenuates the signal 702*c* by three decibels. The attenuated signal is then provided to both speakers 104. This virtualizes the center speaker 112*a* directly in front of the listener 108 (at an angle 306 of zero degrees).

The virtualizer 210 virtualizes the surround sound speakers 112*b* and 112*c* in the same or similar manner as shown in FIG. 5. Input signals 702*d* and 702*e* are filtered by filters 704*a* and 704*b*, and each filtered signal is provided to a forward crossover path 708 that includes a filter 710. The output signals 718 and 720 are fed through two feedback crossover paths 716*a* and 716*b* that each includes a filter 724. Additional output signals 718 and 720 are then produced by combining various ones of the original two input signals 702*a* and 702*b*, the attenuated input signal 702*c*, the filtered input signals 702*d* and 702*e*, the signals produced by the forward crossover paths 708, and the signals produced by the feedback crossover paths 716.

In particular embodiments, the amplitude of the frequency response $P_S$ of the filters 704 may equal an approximation of the amplitude of $$\frac{H_i(\phi)}{H_i(\theta)}.$$

For non-individualized design, the angle 304 could assume of a value of 20°, and the angle 306 could assume of a value of 100°. In this example, the filters 704 could have approximately the frequency response shown in FIG. 7B. The filters 710 and 724 may have frequency responses with the same amplitudes as $$\frac{H_c(\phi)}{H_i(\phi)} \text{ and } \frac{H_c(\theta)}{H_i(\theta)},$$

respectively. These filters 710, 724 may both exhibit low-pass characteristics and can be approximated by low-pass filters with attenuations for non-individualized design. Assuming that the angle 306 equals 100°, a first order IIR low-pass filter with a cut-off frequency at 1500 Hz and an attenuation of 1.5 decibels can be used as the filter 710 for non-individualized design. Assuming that the angle 304 equals 20°, a first order IIR low-pass filter with a cut-off frequency at 2000 Hz and an attenuation of 4.4 decibels can be used as the filter 724.

The virtual surround sound speakers 112*b* and 112*c* can be placed in any suitable location. For conventional 5.1 audio rendering, the angle 306 from the centerline 302 for the virtual surround sound speakers 112*b* and 112*c* is typically between 90° and 120°, although any suitable angle 306 could be used. Low Frequency Effect ("LFE") signals, such as those produced by a subwoofer 106, are typically not directional and can therefore be excluded from the virtualization process. In other words, the sounds emitted by a subwoofer 106 typically have no discernable direction from the perspective of the listener 108, so there is no need to virtualize is the position of the subwoofer 106.

Figure 8A:
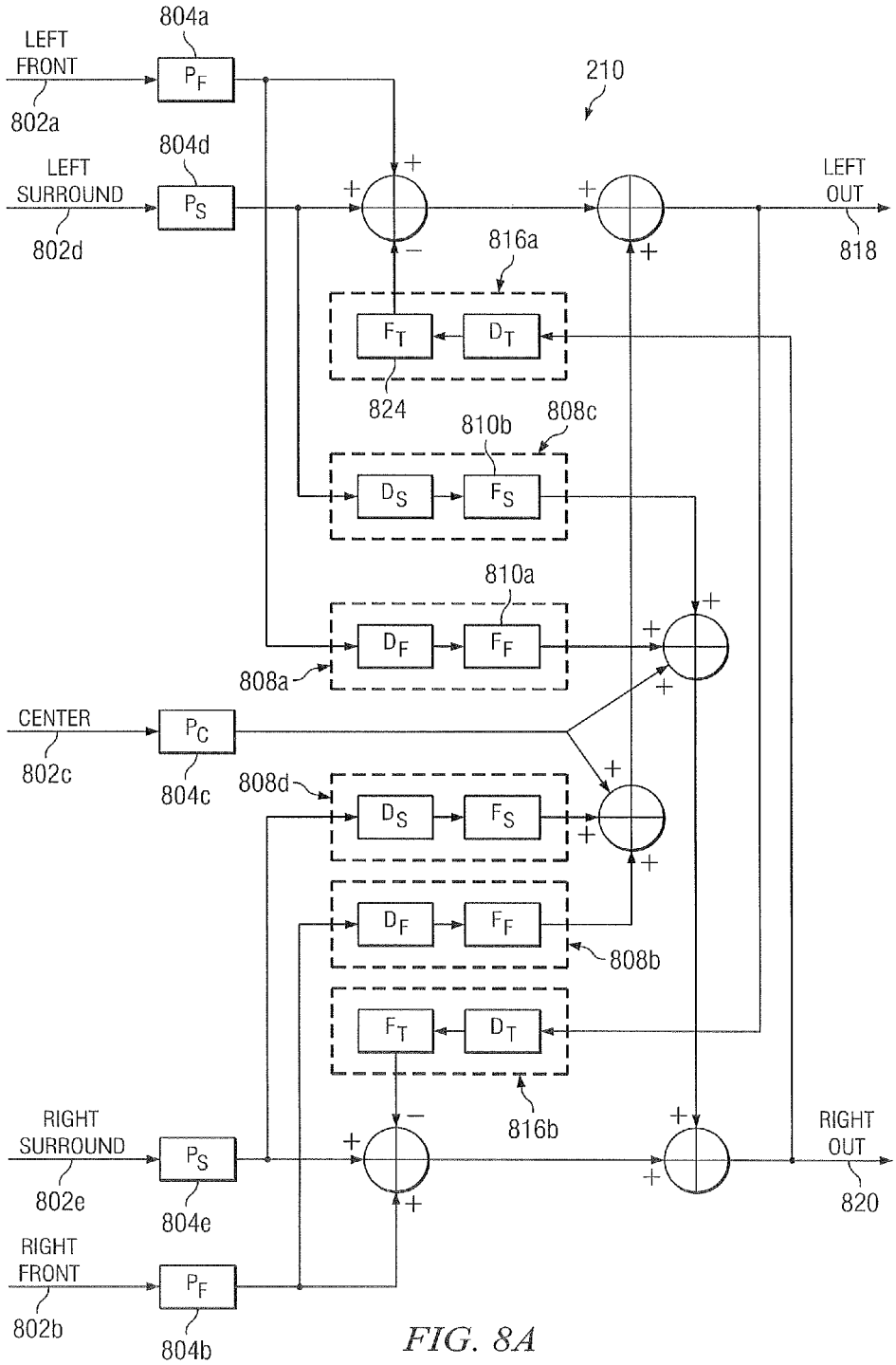
FIGS. 8A through 8C illustrate another example audio virtualizer for emulating a 5.1 audio system according to one embodiment of this disclosure.
Figure 8B:
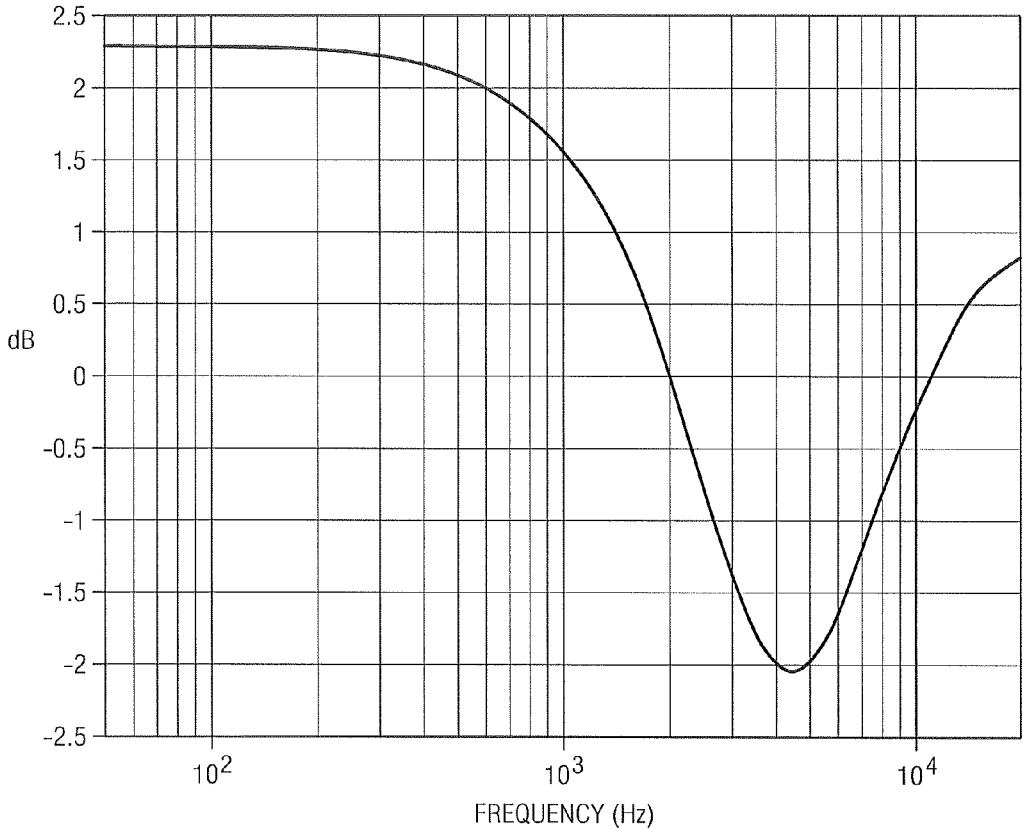
Figure 8C:
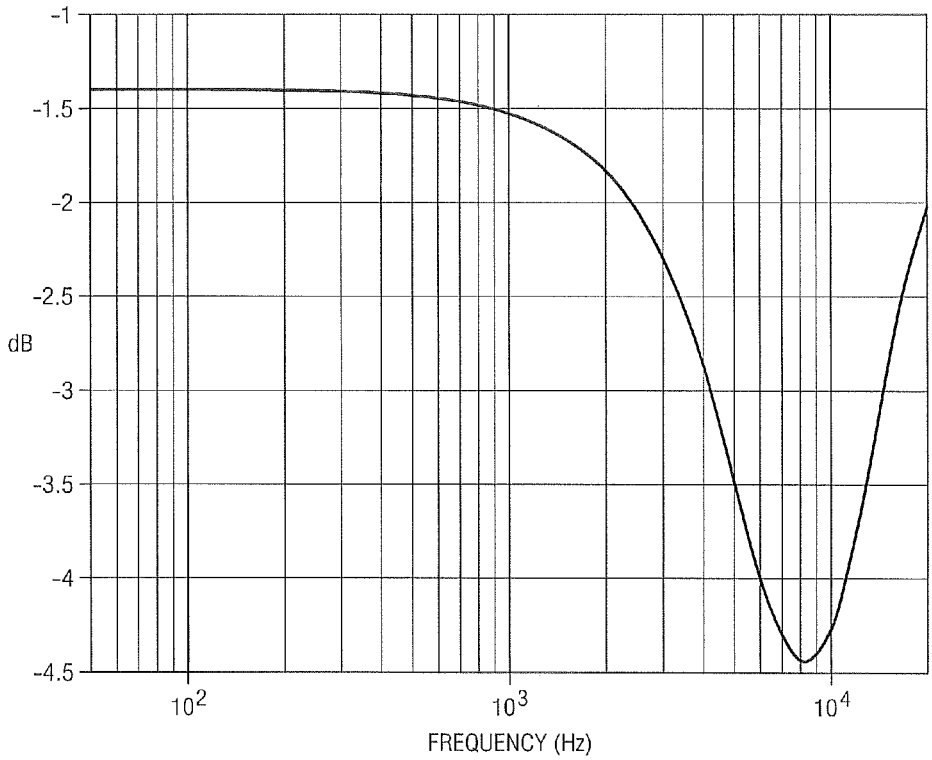

FIGS. 8A through 8C illustrate another example audio virtualizer for emulating a 5.1 audio system according to one embodiment of this disclosure. FIGS. 8A through 8C illustrate another example of a virtualizer 210 for emulating a 5.1 audio system. Other virtualizers 210 could also be used to emulate a 5.1 audio system.

As with the virtualizer 210 shown in FIG. 7A, the virtualizer 210 shown in FIG. 8A emulates a 5.1 audio system. The virtualizer 210 shown in FIG. 8A operates according to the same principles described above with respect to the virtualizers 210 shown in FIGS. 4-6. Using these principles, the virtualizer 210 shown in FIG. 8A virtualizes speakers 112 to emulate a specific audio standard. In this example, the front two speakers 112*d* and 112*e* in the 5.1 audio system are not located at the same locations as the actual speakers 104. The virtualizer 210 therefore virtualizes a center speaker 112*a*, two surround sound speakers 112*b* and 112*c*, and two widened front speakers 112*d* and 112*e*.

In this example, each of five input signals 802*a*-802*e* is received and filtered by one of five filters 804*a*-804*e*. The filtered input signal 802*c* corresponds to the virtual center speaker 112*a* and need not be filtered or processed further. The filtered input signals 802*a* and 802*b* that correspond to the front virtual speakers 112*d* and 112*e* are used to form the output signals 818 and 820. These filtered input signals 802*a* and 802*b* are also provided to two forward crossover paths 808*a* and 808*b*, each of which includes a filter 810*a*. Similarly, the filtered input signals 802*d* and 802*e* corresponding to the virtual surround sound speakers 112*b* and 112*c* are provided to two forward crossover paths 808*c* and 808*d*, each of which includes a filter 810*b*.

The output signals 818 and 820 are fed through two feedback crossover paths 816*a* and 816*b* that each includes a filter 824. Additional output signals 818 and 820 are then produced by combining various ones of the filtered input signals 802, the signals produced by the forward crossover paths 808, and the signals produced by the feedback crossover paths 816.

In particular embodiments, the front virtual speakers 112*d* and 112*e* can be placed at any suitable location, such as locations having an angle 306 of between 50° to 80°. The virtual center speaker 112*a* is typically placed at an angle 306 of zero degrees, and the filter 804*c* has a frequency response with the same amplitude as $$\frac{H_i(0°)}{H_i(\theta)}.$$

A forward crossover path need not be provided for the virtual center speaker 112*a* because the filter in the forward crossover path would have a response of $$\frac{H_c(\phi)}{H_i(\phi)}$$

(which equals one) without any delay. As a result, a forward crossover path is not needed, although one could still be provided if desired.

The frequency response $P_F$ of the filters 804*a* and 804*b* may equal the amplitude of $$\frac{H_i(\omega)}{H_i(\theta)},$$

where ω is the azimuth of the front virtual speakers 112*d* and 112*e*. Low-pass filters could be used for filters 810*a* to approximate $$\frac{H_c(\omega)}{H_i(\omega)}.$$

For non-individualized design, the azimuth could be assumed to equal 70°, and the angle 304 could be assumed to equal 20°. In this example, a filter with a response shown in FIG. 8B can be used for filters 804*a* and 804*b*, and a first order IIR low-pass filter with a cut-off frequency at 1000 Hz and an attenuation of 3 decibels can be used for filters 810*a*. The amplitude of the frequency response PC for filter 804*c* may equal the amplitude of $$\frac{H_i(0°)}{H_i(\theta)}.$$

A non-individualized design for filter 804*c* could be a filter with a response shown in FIG. 8C.

The various virtualizers 210 shown in FIGS. 4-6, 7A, and 8A and the various frequency responses shown in FIGS. 7B, 8B, and 8C are for illustration only. Other designs or arrangements for the virtualizer 210 could be used without departing from the scope of this disclosure. Also, the different embodiments of the virtualizer 210 shown in the figures could be used in the same audio/video device 102. For example, the virtualizer 210 could be implemented using a DSP that can be reconfigured depending on the mode selected by a listener 108. This may allow, for example, the listener 108 to select a suitable operating mode when the audio/video device 102 is used in different circumstances.

Figure 9:
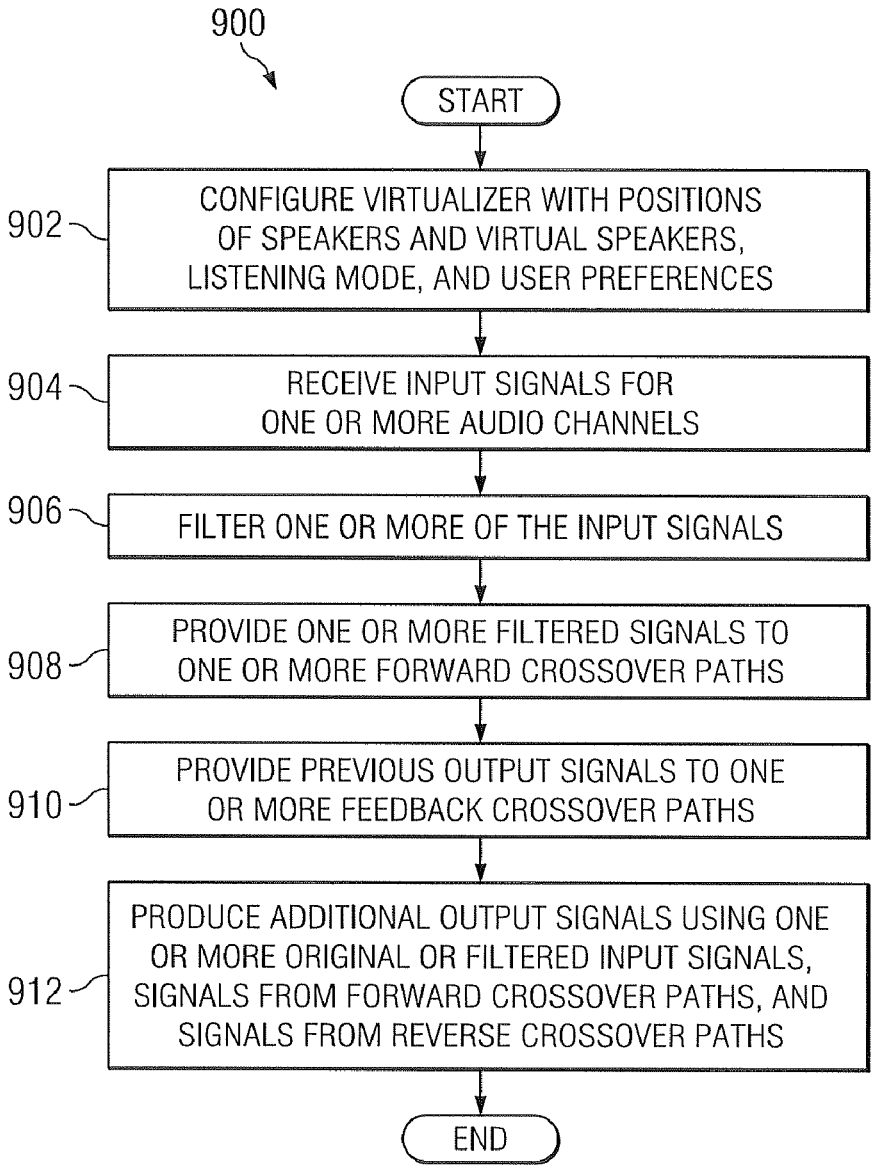
FIG. 9 illustrates an example method for rendering audio information to virtualize speakers according to one embodiment of this disclosure.

FIG. 9 illustrates an example method 900 for rendering audio information to virtualize one or more speakers 112 according to one embodiment of this disclosure. The method 900 is described with respect to the virtualizer 210 of FIG. 8A operating in the audio/video device 102 of FIG. 2B. Other virtualizers or devices could use the method 900 without departing from the scope of this disclosure.

The audio processor 204 configures the virtualizer 210 at step 902. This may include, for example, the controller 212 of the audio processor 204 using the parameters stored in the memory 206 to configure the filter responses and delay lines in the virtualizer 210.

The audio processor 204 receives input signals for one or more audio channels at step 904. This may include, for example, the virtualizer 210 receiving five channels from an audio decoder 250, where the channels are supported by the 5.1 rendering standard.

The audio processor 204 filters one or more of the input signals at step 906. This may include, for example, the virtualizer 210 filtering one, some, or all of the input signals.

The audio processor 204 provides one or more of the filtered signals to one or more forward crossover paths at step 908. This may include, for example, the virtualizer 210 providing a filtered input signal for a virtual center speaker 112*a*, a virtual surround sound speaker 112*b* or 112*c*, or a virtual forward speaker 112*d* or 112*e* to a forward crossover path. This may also include the virtualizer 210 providing one, some, or all of the filtered input signals to one or more forward crossover paths.

The audio processor 204 provides one or more previously generated output signals to one or more feedback crossover paths at step 910. This may include, for example, the virtualizer 210 providing one or more previously produced output signals to one or more feedback crossover paths. This may also include the feedback crossover paths generating one or more out-of-phase signals, which are used to reduce or eliminate crosstalk.

The audio processor 204 produces one or more additional output signals at step 912. This may include, for example, the virtualizer 210 using one or more combiners to combine various ones of the original input signals, the filtered input signals, the signals produced by one or more of the forward crossover paths, and the signals produced by one or more feedback cross over paths.

Although FIG. 9 illustrates one example of a method 900 for rendering audio information to virtualize one or more speakers 112, various changes may be made to FIG. 9. For example, while FIG. 9 shows various steps occurring sequentially, various steps could also be performed concurrently by the audio processor 204. As a particular example, steps 906-912 could operate concurrently when the audio processor 204 receives input audio signals.

This disclosure has described the virtualization of one or more virtual speakers 112 in a two-speaker system 100. However, the same or similar principles can be used to virtualize any number of virtual speakers 112 in a system having any number of physical speakers.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An audio processor, comprising:

a virtualizer configured to process audio information to virtualize at least one speaker such that, from a listener's perspective, sounds appear to come from at least one direction where a physical speaker is not present, the virtualizer comprising:

a first feedback crossover path configured to receive, delay, and filter signals output from the virtualizer; and a forward crossover path configured to receive an output of a first filter, to filter the received signal with a filter approximating filtering required to provide an optimal inter-time difference to virtualize the at least one speaker and to delay an output of the filter to compensate for a difference between a delay introduced by the filter and the optimal inter-time difference, wherein an output of the first feedback crossover path and an output of the forward crossover path are combined to produce at least one output signal from the virtualizer; and a controller configured to cause the virtualizer to virtualize the at least one speaker at any location in a space around the listener.

2. The audio processor of claim 1, wherein the signals output from the virtualizer comprise first output signals and second output signals, and wherein the virtualizer comprises:

the first filter configured to filter input signals comprising the audio information;

a first combiner configured to produce first output signals for a first physical speaker using the output of the first filter;

a second combiner configured to produce second output signals for a second physical speaker using the output of the forward crossover path and the output of the first feedback crossover path; and a second feedback crossover path configured to receive, delay, and filter the second output signals, the first combiner further configured to produce the first output signals using an output of the second feedback crossover path.

3. The audio processor of claim 1, wherein:

the virtualizer comprises at least one first filter, one or more forward crossover paths each comprising a first delay line and a second filter, and two feedback crossover paths each comprising a second delay line and a third filter;

at least one first filter has a frequency response P of $$|P| = \left|\frac{H_i(\phi)}{H_i(\theta)}\right|,$$

at least one second filter has a frequency response F of $$|F| = \left|\frac{H_c(\phi)}{H_i(\phi)}\right|,$$

at least one third filter has a frequency response $F_T$ of $$|F_T| = \left|\frac{H_c(\theta)}{H_i(\theta)}\right|,$$

at least one first delay line provides a delay D of $D=t(\phi)-t(F)$, and at least one second delay line provides a delay $D_T$ of $D_T=t(\theta)-t(F_T)$, wherein θ represents an angle associated with at least one physical speaker, ϕ represents an angle associated with at least one virtualized speaker, $H_i$ represents a transfer function associated with one of the listener's ears, $H_c$ represents a transfer function associated with another of the listener's ears, t(ϕ) represents an inter-time difference associated with the at least one virtualized speaker, t(θ) represents an inter-time difference associated with the at least one physical speaker, t(F) represents a delay associated with at least one second filter, and $t(F_T)$ represents a delay associated with at least one third filter.

4. The audio processor of claim 1, wherein:

the virtualizer comprises two first filters, two forward crossover paths each comprising a first delay line and a second filter, and two feedback crossover paths each comprising a second delay line and a third filter;

at least one first filter has a frequency response $P_S$ of $$|P_S| = \left|\frac{H_i(\phi)}{H_i(\theta)}\right|,$$

at least one second filter has a frequency response $F_S$ of $$|F_S| = \left|\frac{H_c(\phi)}{H_i(\phi)}\right|,$$

at least one third filter has a frequency response $F_T$ of $$|F_T| = \left|\frac{H_c(\theta)}{H_i(\theta)}\right|,$$

at least one first delay line provides a delay $D_S$ of $D_S = t(\phi) - t(F_S)$, and at least one second delay line provides a delay $D_T$ of $D_T = t(\theta) - t(F_T)$, wherein θ represents an angle associated with two physical speakers, ϕ represents an angle associated with two virtualized speakers, $H_i$ represents a transfer function associated with one of the listener's ears, $H_c$ represents a transfer function associated with another of the listener's ears, t(ϕ) represents an inter-time difference associated with the two virtualized speakers, t(θ) represents an inter-time difference associated with the two physical speakers, $t(F_S)$ represents a delay associated with at least one second filter, and $t(F_T)$ represents a delay associated with at least one third filter.

5. An audio processor comprising:

a virtualizer configured to process audio information to virtualize at least one speaker such that, from a listener's perspective, sounds appear to come from at least one direction where a physical speaker is not present, the virtualizer comprising:

a first feedback crossover path configured to receive, delay, and filter signals output from the virtualizer; and a forward crossover path configured to receive, delay, and filter an output of a first filter, wherein an output of the first feedback crossover path and an output of the forward crossover oath are combined to produce at least one output signal from the virtualizer;

a plurality of first filters configured to filter a plurality of input signals, the input signals comprising at least a portion of the audio information;

a plurality of forward crossover paths each configured to receive, delay, and filter an output from one of the first filters;

one or more first combiners configured to produce first output signals for a first physical speaker using an output from at least one of the forward crossover paths and the output from at least one of the first filters;

one or more second combiners configured to produce second output signals for a second physical speaker using an output from at least one other of the forward crossover paths and the output from at least one other of the first filters;

a first feedback crossover path configured to receive, delay, and filter the first output signals, the one or more second combiners further operable to produce the second output signals using an output from the first feedback crossover path; and a second feedback crossover path configured to receive, delay, and filter the second output signals, the one or more first combiners further configured to produce the first output signals using an output from the second feedback crossover path; and a controller configured to cause the virtualizer to virtualize the at least one speaker at any location in a space around the listener.

6. The audio processor of claim 5, wherein:

the one or more first combiners are further operable to produce the first output signals using first unfiltered input signals; and the one or more second combiners are further operable to produce the second output signals using second unfiltered input signals.

7. The audio processor of claim 6, further comprising an attenuator operable to attenuate third unfiltered input signals;

wherein the one or more first combiners are further operable to produce the first output signals using the attenuated third input signals; and wherein the one or more second combiners are further operable to produce the second output signals using the attenuated third input signals.

8. The audio processor of claim 5, further comprising a plurality of additional first filters each operable to filter one of first, second, and third additional input signals;

wherein the one or more first combiners are further operable to produce the first output signals using the filtered first additional input signals and the filtered third additional input signals; and wherein the one or more second combiners are further operable to produce the second output signals using the filtered second additional input signals and the filtered third additional input signals.

9. A device, comprising:

an audio source operable to provide audio information; and an audio processor operable to receive the audio information and process the audio information to virtualize at least one speaker so that, from a listener's perspective, sounds appear to come from at least one direction where a physical speaker is not present, the audio processor being configurable to virtualize the at least one speaker at any location in a space around the listener, the audio processor comprising:

a virtualizer configured to process audio information to virtualize the at least one speaker, the virtualizer comprising:

at least one feedback crossover path configured to receive signals output from the virtualizer, to filter the received signals with a filter approximating filtering required to provide an optimal inter-time difference to virtualize the at least one speaker and to delay an output of the filter to compensate for a difference between a delay introduced by the filter and the optimal inter-time difference; and at least one forward crossover path configured to receive, delay, and filter an output of a first filter, wherein an output of the at least one feedback crossover path and an output of the at least one forward crossover path are combined to produce at least one output signal from the virtualizer; and a controller configured to determine a location of the at least one speaker based on a number of parameters including at least a position of at least one actual speaker and configured to cause the virtualizer to virtualize the at least one speaker at the determined location by individually altering a frequency response of one or more crossover path filters and a delay of one or more of crossover path delay lines.

10. A device comprising:

an audio source operable to provide audio information; and an audio processor operable to receive the audio information and process the audio information to virtualize at least one speaker so that, from a listener's perspective, sounds appear to come from at least one direction where a physical speaker is not present, the audio processor being configurable to virtualize the at least one speaker at any location in a space around the listener, the audio processor comprising:

one or more first filters operable to filter one or more input signals comprising at least a portion of the audio information;

a virtualizer configured to process audio information to virtualize the at least one speaker, the virtualizer comprising:

at least one feedback crossover path configured to receive, delay, and filter signals output from the virtualizer; and at least one forward crossover path configured to receive, delay, and filter an output of a first filter, the at least one forward crossover path including one or more forward crossover paths each operable to receive, delay, and filter an output from one of the filters, wherein an output of the at least one feedback crossover path and an output of the at least one forward crossover path are combined to produce at least one output signal from the virtualizer;

a controller configured to determine a location of the at least one speaker based on a number of parameters including at least a position of at least one actual speaker and configured to cause the virtualizer to virtualize the at least one speaker at the determined location by individually altering a frequency response of one or more crossover path filters and a delay of one or more of crossover path delay lines;

one or more first combiners operable to produce first output signals for a first physical speaker using one or more of: one or more of the input signals, one or more outputs from the first filters, and one or more outputs from the forward crossover paths;

one or more second combiners operable to produce second output signals for a second physical speaker using one or more of: one or more of the input signals, one or more outputs from the first filters, and one or more outputs from the forward crossover paths;

a first feedback crossover path operable to receive, delay, and filter the first output signals, the one or more second combiners further operable to produce the second output signals using an output from the first feedback crossover path; and a second feedback crossover path operable to receive, delay, and filter the second output signals, the one or more first combiners further operable to produce the first output signals using an output from the second feedback crossover path.

11. The device of claim 10, further comprising an attenuator operable to attenuate additional input signals;

wherein the one or more first combiners are further operable to produce the first output signals using the attenuated input signals; and wherein the one or more second combiners are further operable to produce the second output signals using the attenuated input signals.

12. The device of claim 10, wherein:

each forward crossover path comprises a first delay line and a second filter; and each feedback crossover path comprises a second delay line and a third filter.

13. The device of claim 10, wherein the audio processor is operable to virtualize five speakers using two physical speakers.

14. The device of claim 10, wherein the audio source comprises at least one of a television tunes, a radio tuner, a CD reader, and a DVD reader.

15. The device of claim 10, wherein the audio source comprises an audio/video source operable to provide both audio and video information; and further comprising a video processor operable to process the video information.

16. A method, comprising:

receiving a first physical speaker signal;

generating first output signals for a first physical speaker; and generating second output signals for a second physical speaker, wherein the first and second output signals are generated from the received first physical speaker signal, wherein generating the second output signal comprises combining an output of at least one feedback crossover path and a first forward crossover signal received from a first forward crossover path, the at least one feedback crossover path operable to receive the first output signal, to filter the received first output signal with a feedback crossover path filter approximating filtering required to provide an optimal inter-time difference to virtualize the at least one speaker and to delay an output of the feedback crossover path filter to compensate for a difference between a delay introduced by the feedback crossover path filter and the optimal inter-time difference, and the first forward crossover path operable to receive a first input signal, to filter the first input signal with a first forward crossover path filter approximating filtering required to provide an optimal inter-time difference to virtualize the at least one speaker and to delay an output of the first forward crossover path filter to compensate for a difference between a delay introduced by the first forward crossover path filter and the optimal inter-time difference.

17. The method of claim 16, further comprising:

filtering one or more input signals to produce one or more filtered input signals;

providing one or more of the filtered input signals to one or more forward crossover paths; and generating the first and second output signals using one or more of: one or more of the input signals, one or more of the filtered input signals, and one or more outputs from the forward crossover paths;

wherein generating the first output signals further comprises using an output from the second feedback crossover path;

wherein generating the second output signals further comprises using an output from the first feedback crossover path; and wherein the first output signals emulate effects of a virtual speaker on one ear of a listener, the second output signals emulate effects of the virtual speaker on another ear of the listener, and each of the output signals at least partially cancels crosstalk caused by the other output signals.

18. The method of claim 16, wherein providing further comprises:

providing the second output signals to a first feedback crossover path operable to receive, delay, and filter the second output signals; and providing the first output signals to a second feedback crossover path operable to receive, delay, and filter the first output signals.

19. The method of claim 18, wherein the first and second output signals are produced using one or more first filters, one or more forward crossover paths each comprising a first delay line and a second filter, and two feedback crossover paths each comprising a second delay line and a third filter; and individually altering a frequency response of one or more of the filters and a delay of one or more of the delay lines to change the location of one or more of the virtualized speakers.

20. The method of claim 19, wherein the first and second output signals emulate the effects of multiple virtual speakers on the ears of the listener.

21. The method of claim 19, wherein the first and second output signals emulate the effects of multiple virtual speakers at any locations in a space around the listener.

* * * * *